US011282627B2

(12) United States Patent
Wang et al.

(10) Patent No.: US 11,282,627 B2
(45) Date of Patent: Mar. 22, 2022

(54) TRANSFORMER CORES AND ASSEMBLY METHODS THEREOF FOR HIGH EFFICIENCY AND HIGH ANTI-CORROSION PERFORMANCE

(71) Applicants: Siemens Energy Global GmbH & Co. KG, Munich (DE); Hainan Jinpan Smart Technology Co., Ltd., Hainan (CN)

(72) Inventors: Zhongbo Wang, Haikou (CN); Martin Alsina Navarro, Sao Paulo (BR); Andre Luiz Moreno, Varzea Paulista (BR); Wei Chen, Haikou (CN); Hui Li, Haikou (CN)

(73) Assignees: SIEMENS ENERGY GLOBAL GMBH & CO. KG, Munich (DE); HAINAN JINPAN SMART TECHNOLOGY CO., LTD, Hainan (CN)

( * ) Notice: Subject to any disclaimer, the term of this patent is extended or adjusted under 35 U.S.C. 154(b) by 0 days.

(21) Appl. No.: 17/045,932

(22) PCT Filed: Apr. 23, 2018

(86) PCT No.: PCT/CN2018/084068
§ 371 (c)(1),
(2) Date: Oct. 7, 2020

(87) PCT Pub. No.: WO2019/204962
PCT Pub. Date: Oct. 31, 2019

(65) Prior Publication Data

US 2021/0057141 A1 Feb. 25, 2021

(51) Int. Cl.
*H01F 27/24* (2006.01)
*H01F 27/26* (2006.01)
(Continued)

(52) U.S. Cl.
CPC ..... *H01F 27/263* (2013.01); *H01F 27/28* (2013.01); *H01F 41/0206* (2013.01)

(58) Field of Classification Search
CPC .... H01F 27/263; H01F 27/28; H01F 41/0206; H01F 27/245; H01F 27/2455
See application file for complete search history.

(56) References Cited

U.S. PATENT DOCUMENTS 2,910,663 A * 10/1959 Wilk ..... H01F 27/263 336/210
3,129,377 A * 4/1964 Monroe ..... H01F 30/14 363/154

(Continued)

FOREIGN PATENT DOCUMENTS

DE 1613654 A1 5/1970
WO 2015142354 A1 9/2015

OTHER PUBLICATIONS

PCT Written Opinion of the International Searching Authority dated Jan. 21, 2019 corresponding to PCT Application No. PCT/CN2018/084068 filed Apr. 23, 2018.

(Continued)

*Primary Examiner* — Mang Tin Bik Lian

(57) ABSTRACT

A transformer core for a dry-type transformer includes a laminated construction having several groups of stacked laminations that form a step-lap sequence of laminations. Each group in the step-lap sequence has a mean length different than an adjacent group in the step-lap sequence and has at least two identical laminations per group, wherein at least one group has at least four identical laminations. Methods of assembling a transformer core are also provided, as are other aspects.

17 Claims, 9 Drawing Sheets

(51) Int. Cl.
*H01F 27/28* (2006.01)
*H01F 41/02* (2006.01)

(56) References Cited

U.S. PATENT DOCUMENTS 3,270,307 A * 8/1966 Jean ..... H01F 27/245 336/217
3,411,121 A * 11/1968 Twomey ..... H01F 27/263 336/210
3,614,695 A * 10/1971 Palmer ..... H01F 27/263 336/210
4,140,987 A * 2/1979 Maezima ..... H01F 27/245 336/217
4,200,854 A * 4/1980 DeLaurentis ..... H01F 27/245 29/606
4,283,842 A * 8/1981 DeLaurentis ..... H01F 27/245 29/606
4,345,232 A * 8/1982 DeLaurentis ..... H01F 27/263 336/210
4,972,168 A 11/1990 Grimes et al.
5,959,523 A * 9/1999 Westberg ..... H01F 27/245 336/216
6,060,978 A 5/2000 Marquardt
8,212,645 B2 7/2012 Navarro et al.
8,614,614 B2 12/2013 Navarro et al.
9,142,349 B2 * 9/2015 Wang ..... H01F 41/0233
9,640,314 B2 5/2017 Singh et al.
2006/0226946 A1 * 10/2006 Pauley ..... H01F 27/245 336/234
2006/0226947 A1 * 10/2006 Pauley, Jr. ..... H01F 27/245 336/234
2013/0147588 A1 * 6/2013 Sarver ..... H01F 41/02 336/5

OTHER PUBLICATIONS

Martin A. Navarro and Antonio J. Monteiro, "Submersible Dry-Type Transformer", IEEE Transactions on Power Delivery, vol. 30, No. 5, Oct. 2015.

* cited by examiner

TRANSFORMER CORES AND ASSEMBLY METHODS THEREOF FOR HIGH EFFICIENCY AND HIGH ANTI-CORROSION PERFORMANCE

FIELD

This disclosure relates to transformers used for electric power distribution and, more particularly, to transformer cores and laminated construction assembly methods thereof.

BACKGROUND

Transformers are used to increase or decrease voltage levels during electrical power distribution. To transmit electrical power over a long distance, a transformer may be used to raise the voltage of the power being transmitted, which reduces the current. A reduced current reduces resistive power losses that occur in the electrical cables used to transmit the power. When the power is to be delivered at an end user location, another transformer may be used to reduce the voltage, which increases the current, to a level specified by the end user.

One type of transformer that may be used in electrical power distribution is a submersible, dry-type transformer, as described, e.g., in U.S. Pat. No. 8,614,614. Such transformers may be located in, e.g., an underground power distribution network common in some cities. These transformers may be in contact with and need to be protected from harsh environments that may include exposure to water, humidity, pollution, and the like. In particular, the transformer core needs to be protected in order to maintain the electromagnetic performance of the transformer. A laminated core construction of such transformers may, however, be prone to corrosion. Accordingly, improved laminated core construction and assembly methods thereof for submersible and other dry-type transformers are desired.

SUMMARY

According to one aspect, a transformer core includes a plurality of laminations stacked together having a step-lap sequence of laminations. The step-lap sequence has a first sub-plurality of the laminations each having a first mean length and aligned longitudinally with and stacked directly to each other. The step-lap sequence also has a second sub-plurality of the laminations each having a second mean length and aligned longitudinally with and stacked directly to each other, wherein the second sub-plurality of the laminations is stacked directly to the first sub-plurality of the laminations. The first sub-plurality of the laminations or the second sub-plurality of the laminations has at least four laminations, and the first mean length is different than the second mean length.

According to another aspect, a transformer includes a transformer core having a plurality of legs, a lower yoke, and an upper yoke, wherein each leg is interconnected to the lower yoke and to the upper yoke via a step-lap joint. The transformer also includes a plurality of coils, each coil surrounding a respective leg. Each leg, the lower yoke, and the upper yoke includes a respective plurality of laminations stacked together having a step-lap sequence of laminations that includes a first sub-plurality of the laminations each having a first mean length and aligned longitudinally with and stacked directly to each other, and a second sub-plurality of the laminations each having a second mean length and aligned longitudinally with and stacked directly to each other, wherein the second sub-plurality of the laminations is stacked directly to the first sub-plurality of the laminations. The first sub-plurality of the laminations or the second sub-plurality of the laminations has at least four laminations, and the first mean length is different than the second mean length.

According to a further aspect, a method of constructing a transformer core includes receiving a plurality of laminations, stacking directly to each other a first sub-plurality of laminations aligned longitudinally with each other and each having a first mean length, stacking directly to each other a second sub-plurality of laminations aligned longitudinally with each other and each having a second mean length, and stacking the second sub-plurality of the laminations directly to the first sub-plurality of the laminations. The first sub-plurality of the laminations or the second sub-plurality of the laminations has at least four laminations, and the first mean length is different than the second mean length.

Still other aspects, features, and advantages in accordance with these and other embodiments of this disclosure may be readily apparent from the following detailed description, the appended claims, and the accompanying drawings. The descriptions and drawings are to be regarded as illustrative in nature, and not as restrictive.

BRIEF DESCRIPTION OF THE DRAWINGS

The drawings, described below, are for illustrative purposes only and are not necessarily drawn to scale. The drawings are not intended to limit the scope of this disclosure in any way. Wherever possible, the same or like reference numbers will be used throughout the drawings to refer to the same or like parts.

DETAILED DESCRIPTION

Submersible dry-type transformers are configured to operate in open air, underground, partially submerged, or completely submerged, and are often used in underground power distribution networks. Such transformers, and particularly their transformer core, may thus be exposed to harsh environments that may include contact with water, pollutants, humidity, etc. Submersible dry-type transformers are often configured to deliver multiple phases of electrical power, such as 2-phase or 3-phase, and may have a power rating in the range of 500 kVA to about 2000 kVA and a voltage rating of 15-kV or 25-kV.

Figure 1:
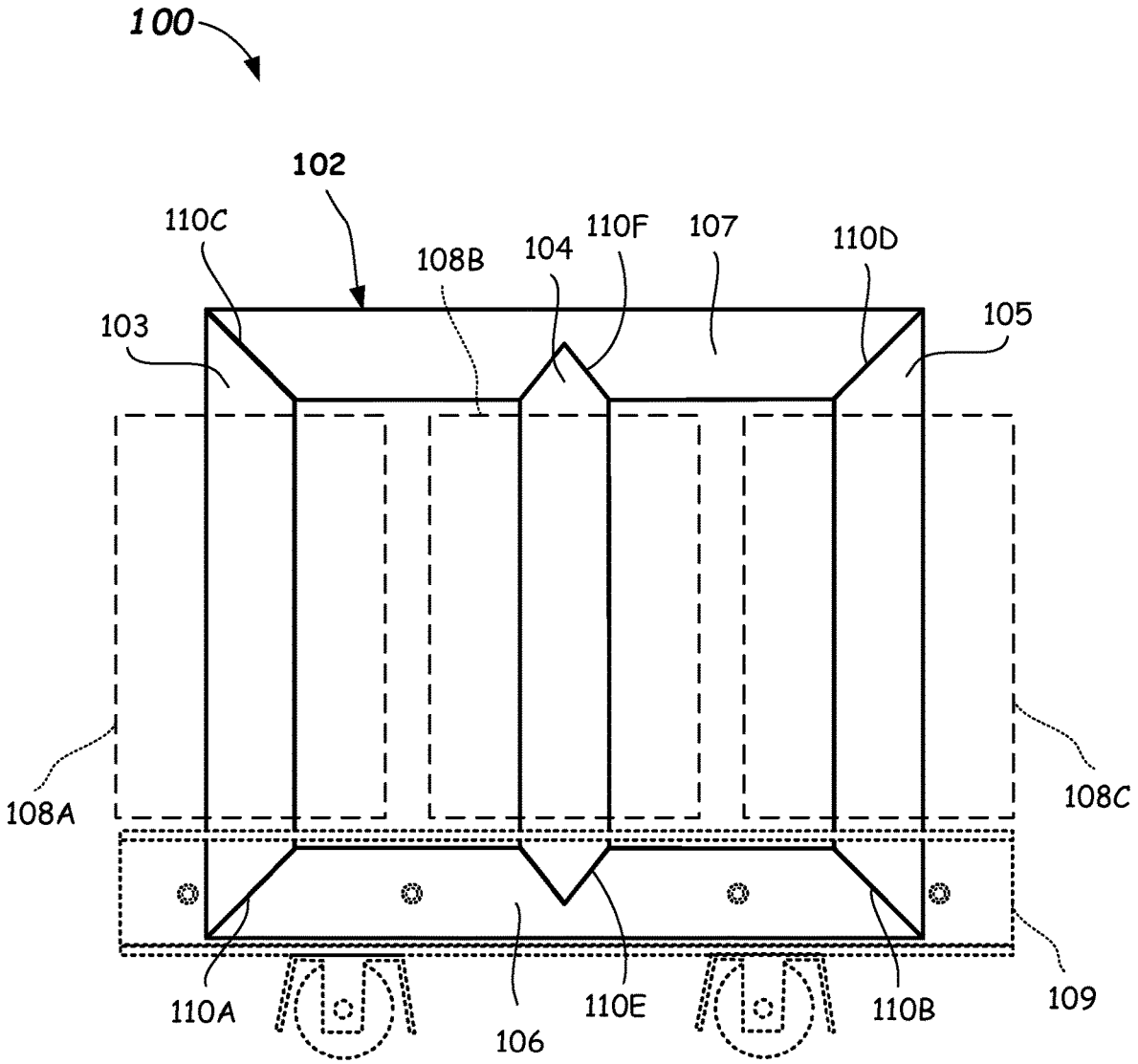
FIG. 1 illustrates a simplified front view of a submersible dry-type transformer according to embodiments.

FIG. 1 illustrates a three-phase transformer 100, which may be a submersible dry-type transformer, in accordance with one or more embodiments. In other embodiments, transformer 100 may have a different number of phases (e.g., two phases) and may also be single phase (which may be 1 phase+1 phase, 1 phase+neutral, or 1 phase+ground). Transformer 100 may include a transformer (magnetic) core 102 through which a magnetic flux flows. Transformer core 102 may be painted or otherwise coated with an anti-corrosive paint or sealer to protect transformer core 102 from its environment. Transformer core 102 may be a formed, e.g., by having a first leg 103, a second leg 104, and a third leg 105 interconnected to a lower yoke 106 and an upper yoke 107. Other embodiments may have, e.g., two, four, or five legs. Each leg 103-105 may be surrounded by a respective voltage transformer coil 108A-C (shown in phantom), each of which may also be referred to as a winding. In some embodiments, transformer coils 108A-C may each include a high voltage coil and an inner low voltage coil, which may be concentric. The inner low voltage coil may be electrically isolated from transformer core 102 and from the high voltage coil. The lower yoke 106 may be clamped to the bottom end of each of legs 103-105 via a clamp 109 (shown in phantom), which may be, e.g., a pair of steel beams bolted together with the lower yoke 106 and legs 103-105 located there between. Other known components of a transformer (e.g., an upper clamp, coil housings, shielding, insulation, voltage terminals, grounding connections, cables creating delta or wye transformer configurations, etc.) are not shown in FIG. 1 for clarity.

Transformer core 102 may have a laminated construction. That is, transformer core 102 may be made from thousands of thin electrical steel laminations stacked together. Electrical steel is a special type of steel fabricated to produce specific magnetic properties. In some embodiments, each lamination may range in thickness from 0.2 mm to 0.5 mm. Laminations may have other thicknesses. Each of lower yoke 106, upper yoke 107, and legs 103-105 may be formed from a respective stack of laminations and then joined together to form lamination layers of transformer core 102. The longitudinal ends of each leg and the upper and lower yokes may have a diagonal cut as shown in FIG. 1. For example, each longitudinal end of legs 103 and 105 may have a 45 degree diagonal cut, while each longitudinal end of leg 104 may have a centered V-shape cut (in a vertical cutting and assembly process). In other embodiments, leg 104 may have an offset V-shape cut (in a horizontal cutting and assembly process), as described below in connection with FIG. 5A. Each longitudinal end of lower yoke 106 and upper yoke 107 may also have a 45 degree diagonal cut (to complement the diagonal cuts of legs 103 and 105). Lower yoke 106 and upper yoke 107 may also have a V-shaped notch cut into an inside longitudinal edge (to complement the V-shaped longitudinal end of leg 104). Transformer core 102 may further be assembled, in some embodiments, by abutting one longitudinal end of each leg 103-105 to lower yoke 106 to form diagonal joints 110A and 110B and V-shaped joint 110E between the laminations. That E-shaped assembly (the E being on its back) may be clamped together with clamp 109, and may be painted or otherwise protected with an anti-corrosive paint, coating, or sealer. Upper yoke 107 may then be abutted to the other longitudinal end of each leg 103-105 to form diagonal joints 110C and 110D and V-shaped joint 110F between the laminations. The upper portion of the transformer core assembly may then be clamped and protected with the anti-corrosive paint, coating, or sealer.

To reduce magnetic core losses, e.g., eddy currents (which represent lost energy), and/or transformer noise caused by magnetic flux flowing through joints 110A-F, the abutted ends of each lamination of the leg and yoke at joints 110A-F may be a "step-lap" joint. A step-lap joint is created by staggering or offsetting the location of the joint in one or more succeeding lamination layers relative to one another.

Figure 2:
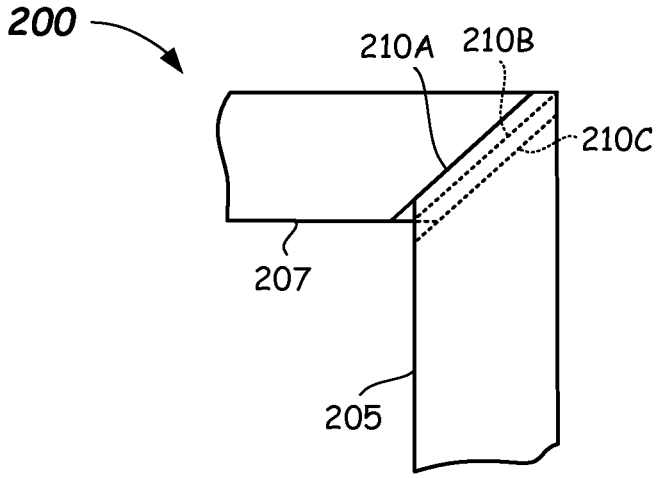
FIG. 2 Prior Art
FIG. 2 illustrates a front view of a transformer core corner according to the prior art.
Figure 2A:
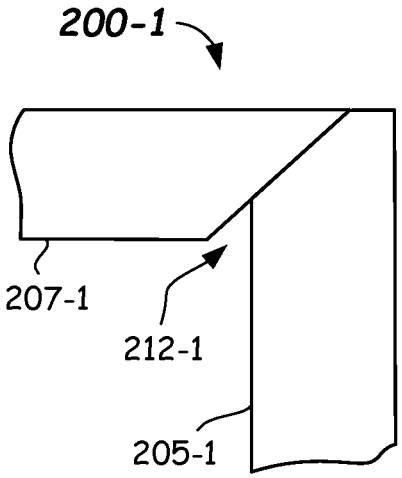
FIGS. 2A-2C illustrate front views of individual lamination layers of the transformer core corner of FIG. 2.
Figure 2B:
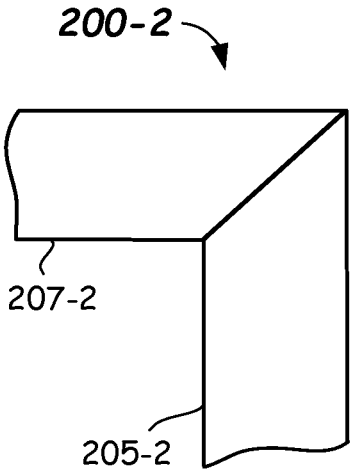
Figure 2C:
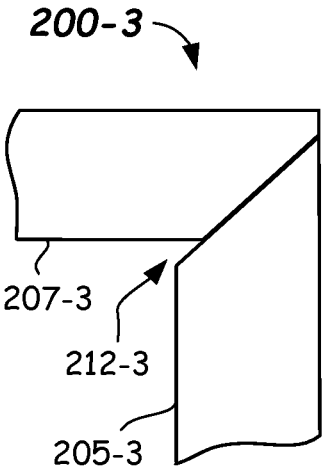
Figure 3:
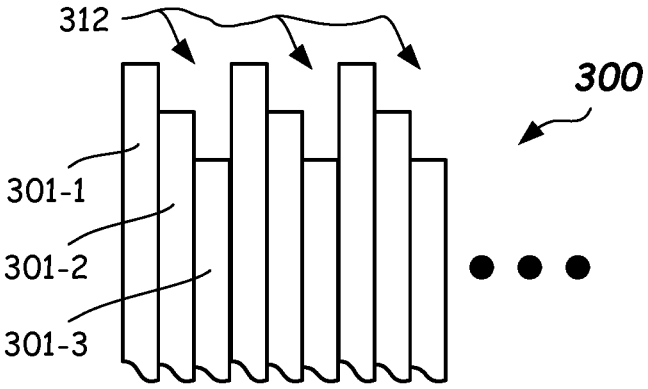
FIG. 3 Prior Art
FIG. 3 illustrates a step-lap profile used in the transformer core corner of FIG. 2 according to the prior art.

For example, FIG. 2 illustrates a transformer core corner 200 of an upper yoke 207 interconnected with a leg 205 using a known step-lap profile 300, shown in FIG. 3. Step-lap profile 300 has three steps, each step having a respective single lamination 301-1, 301-2, and 301-3. (While some known step-lap profiles may have two laminations per step (e.g., two laminations 301-1, two laminations 301-2, etc.), they may have the same disadvantages as step-lap profile 300, described below). The three steps may be repeated many times to form a transformer core leg or yoke having a desired thickness or number of laminations. Step-lap profile 300 may form staggered step-lap joints 210A, 210B, and 210C as shown in FIG. 2. FIGS. 2A-2C illustrate, respectively, the first three lamination layers 200-1, 200-2, and 200-3 of transformer core corner 200. Lamination layer 200-1 includes a yoke lamination 207-1 and a leg lamination 205-1; lamination layer 200-2 includes a yoke lamination 207-2 and a leg lamination 205-2; and lamination layer 200-3 includes a yoke lamination 207-3 and a leg lamination 205-3. Yoke lamination 207-1 has a mean length shorter than yoke lamination 207-2, which has a mean length shorter than yoke lamination 207-3. Conversely, leg lamination 205-1 has a mean length longer than leg lamination 205-2, which has a mean length longer than leg lamination 205-3. According, laminations 301-1, 301-2, and 301-3 of step-lap profile 300 may respectively represent yoke lamination 207-3 (the longest yoke lamination), yoke lamination 207-2, and yoke lamination 207-1 (the shortest yoke lamination), while laminations 301-1, 301-2, and 301-3 may also respectively represent leg lamination 205-1 (the longest leg lamination), leg lamination 205-2, and leg lamination 205-3 (the shortest leg lamination).

Note that, as shown in FIG. 2A, lamination layer 200-1 has a gap 212-1 between upper yoke lamination 207-1 and leg lamination 205-1 and, as shown in FIG. 2C, lamination layer 200-3 has a gap 212-3 between upper yoke lamination 207-3 and leg lamination 205-3. As the three steps of step-lap profile 300 repeat to form a desired transformer core thickness, gaps 212-1 and 212-3 also repeat creating a sudden change in surface geometry that includes very small, steep, and/or narrow "valleys" 312 in the inside corners of the yoke and leg interconnections. Note that known step-lap profiles with additional single lamination steps (e.g., 4, 5, 6, or 7) may further increase the steepness and/or narrowness of valleys 312. Valleys 312 are problematic because they may be difficult to fully and/or adequately protect with an anti-corrosive paint, coating, and/or sealer, thus exposing those areas to the environment. In harsh environments, as described above, significant degradation of transformer performance can occur within only months of unprotected or inadequately protected exposure.

In one or more aspects, therefore, an improved step-lap profile and laminated construction of a transformer core is provided, as described in detail below, that may improve the corrosive resistance of the assembled transformer core by allowing an anti-corrosive paint, coating, and/or sealer (e.g., comprising silicone) to easily reach or be applied to the inside corners of transformer core yoke and leg interconnections. The improved step-lap profile may also reduce manufacturing complexity and cost compared to other transformer core manufacturing techniques. The improved step-lap profile may further improve the magnetic flux flow, reduce transformer noise and, thus, the overall performance of the transformer core.

In other aspects, methods of assembling a transformer core are provided, as will be described in more detail below in connection with FIGS. 1 and 4-14.

Figure 4:
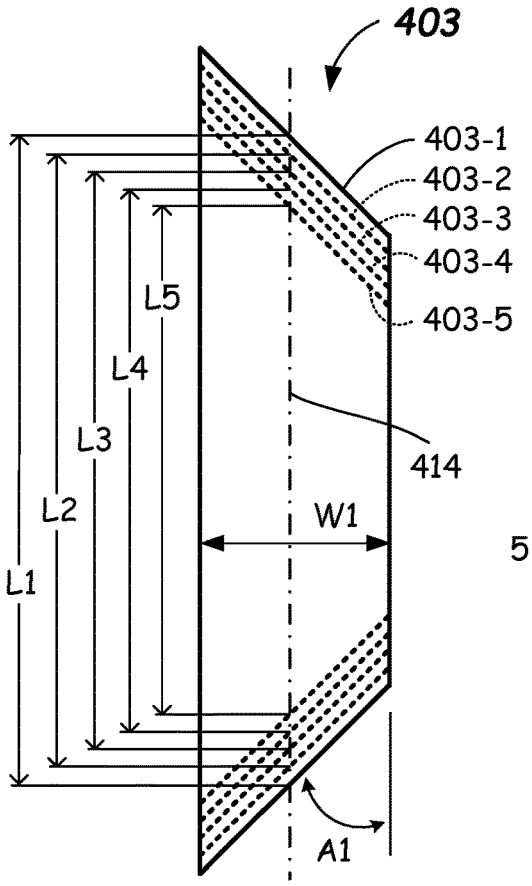
FIGS. 4, 5, 5A, and 6 illustrate front views of transformer core leg laminations according to embodiments.

FIGS. 4-8 illustrate transformer core leg and yoke laminations that may be used to construct transformer core 102 (of FIG. 1) with step-lap joints in accordance with one or more embodiments. As shown in FIG. 4, leg laminations 403 may include a first leg lamination 403-1 having a mean length L1 (all mean lengths measured along a center longitudinal axis 414); a second leg lamination 403-2 having a mean length L2, which is shorter than mean length L1; a third leg lamination 403-3 having a mean length L3, which is shorter than mean length L2; a fourth leg lamination 403-4 having a mean length L4, which is shorter than mean length L3; and a fifth leg lamination 403-5 having a mean length L5, which is shorter than mean length L4. Each of leg laminations 403-1, 403-2, 403-3, 403-4, and 403-5 has a same transverse width W1. A dimension of transverse width W1 may be determined, in part, by desired magnetic flux properties of the transformer core. Each of leg laminations 403-1, 403-2, 403-3, 403-4, and 403-5 has a diagonal cut at each of their longitudinal ends, which may be at an angle A1 of about 45 degrees. Other suitable angles are possible for the diagonal cuts. Leg laminations 403 may be used to construct, e.g., leg 103 or leg 105 of transformer core 102 (of FIG. 1), as described in more detail below.

Figure 5:
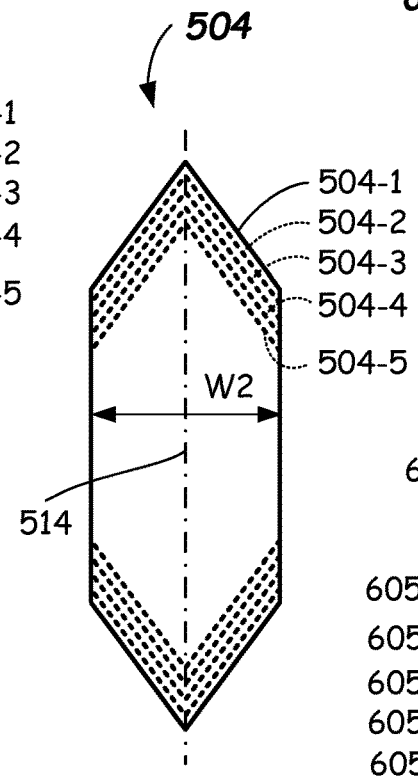

FIG. 5 illustrates leg laminations 504, which may include a first leg lamination 504-1 having a first mean length (all mean lengths measured along a center longitudinal axis 514); a second leg lamination 504-2 having a second mean length, which is shorter than the first mean length; a third leg lamination 504-3 having a third mean length, which is shorter than the second mean length; a fourth leg lamination 504-4 having a fourth mean length, which is shorter than the third mean length; and a fifth leg lamination 504-5 having a fifth mean length, which is shorter than the fourth mean length. Each of leg laminations 504-1, 504-2, 504-3, 504-4, and 504-5 has a same transverse width W2, which may be the same as transverse width W1. A dimension of transverse width W2 may be determined, in part, by desired magnetic flux properties of the transformer core. Each of leg laminations 504-1, 504-2, 504-3, 504-4, and 504-5 has centered V-shaped longitudinal ends (for the vertical type cut process), as shown. Other suitable shapes are possible at the longitudinal ends. Leg laminations 504 may be used to construct, e.g., leg 104 of transformer core 102 (of FIG. 1), as described in more detail below.

Figure 5A:
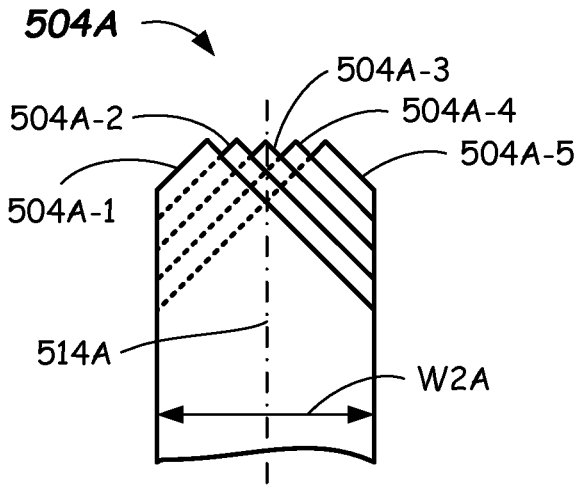

FIG. 5A illustrates alternative leg laminations 504A, which may be formed by a horizontal cutting and assembly process, in accordance with one or more embodiments. Leg laminations 504A may include: a first leg lamination 504A-1 having a first offset V-shape at each longitudinal end (only one longitudinal end shown for each lamination); a second leg lamination 504A-2 having a second offset V-shape at each longitudinal end, the tip of the second offset V-shape positioned horizontally to the right (as shown) of the tip of the first offset V-shape; a third leg lamination 504A-3 having a third offset V-shape (which in some embodiments may be a centered V-shape) at each longitudinal end, the tip of the third offset V-shape positioned horizontally to the right (as shown) of the tip of the second offset V-shape; a fourth leg lamination 504A-4 having a fourth offset V-shape at each longitudinal end, the tip of the fourth offset V-shape positioned horizontally to the right (as shown) of the tip of the third offset V-shape; and a fifth leg lamination 504A-5 having a fifth offset V-shape at each longitudinal end, the tip of the fifth offset V-shape positioned horizontally to the right (as shown) of the tip of the fourth offset V-shape. In some embodiments, the order of leg laminations 504A-1, 504A-2, 504A-3, 504A-4, and 504A-5 may be reversed from that shown (i.e., may start with leg lamination 504A-5), or may start with leg lamination 504A-3 (i.e., the middle lamination). Each of leg laminations 504A-1, 504A-2, 504A-3, 504A-4, and 504A-5 has a same longitudinal length measured from the tip of the V-shape at one longitudinal end to the tip of the V-shape at the other longitudinal end. Each of leg laminations 504A-1, 504A-2, 504A-3, 504A-4, and 504A-5 has a same transverse width W2A, which may be the same as transverse width W1 and/or W2. A dimension of transverse width W2A may be determined, in part, by desired magnetic flux properties of the transformer core. Each of the V-shaped ends of leg laminations 504A-1, 504A-2, 504A-3, 504A-4, and 504A-5 may be cut at 45 degree angles with respect to a longitudinal axis 514A. Other suitable angles are possible for the V-shaped longitudinal ends. Leg laminations 504A may be used to construct, e.g., leg 104 of transformer core 102 (of FIG. 1), as described in more detail below.

Figure 6:
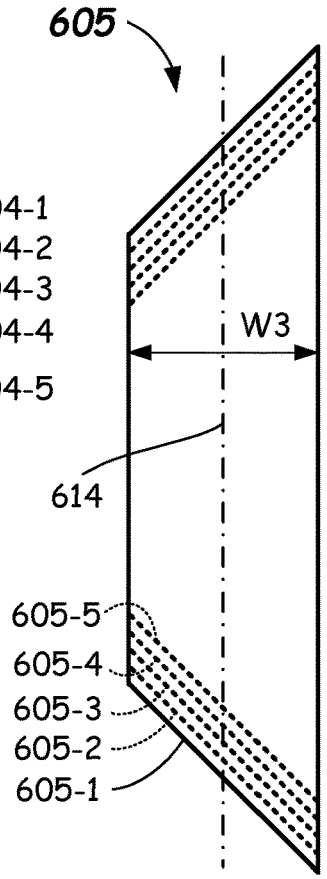

FIG. 6 illustrates leg laminations 605, which may be identical to leg laminations 403 (which may be flipped along a vertical axis). Leg laminations 605 may include a first leg lamination 605-1 having a first mean length (all mean lengths measured along a center longitudinal axis 614) that may be equal to mean length L1; a second leg lamination 605-2 having a second mean length that may be equal to mean length L2, which is shorter than the first mean length; a third leg lamination 605-3 having a third mean length that may be equal to mean length L3, which is shorter than the second mean length; a fourth leg lamination 605-4 having a fourth mean length that may be equal to mean length L4, which is shorter than the third mean length; and a fifth leg lamination 605-5 having a fifth mean length that may be equal to mean length L5, which is shorter than the fourth mean length. Each of leg laminations 605-1, 605-2, 605-3, 605-4, and 605-5 has a same transverse width W3, which may be the same as transverse width W1 and/or W2. A dimension of transverse width W3 may be determined, in part, by desired magnetic flux properties of the transformer core. Each of leg laminations 605-1, 605-2, 605-3, 605-4, and 605-5 has a diagonal cut at each of their longitudinal ends, which may be about 45 degrees with respect to longitudinal axis 614 (i.e., same as angle A1). Other suitable angles are possible for the diagonal cuts. Leg laminations 605 may be used to construct, e.g., leg 103 or leg 105 of transformer core 102 (of FIG. 1), as described in more detail below.

Figure 7:
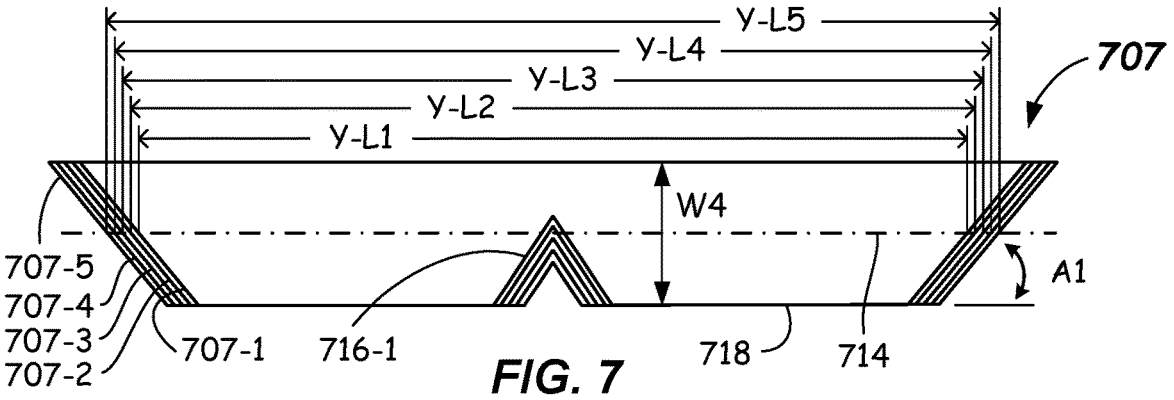
FIGS. 7 and 8 illustrate front views of transformer core yoke laminations according to embodiments.

FIG. 7 illustrates upper yoke laminations 707, which may include a first yoke lamination 707-1 having a mean length Y-L1 (all mean lengths measured along a center longitudinal axis 714); a second yoke lamination 707-2 having a mean length Y-L2, which is longer than mean length Y-L1; a third yoke lamination 707-3 having a mean length Y-L3, which is longer than mean length Y-L2; a fourth yoke lamination 707-4 having a mean length Y-L4, which is longer than mean length Y-L3; and a fifth yoke lamination 707-5 having a mean length Y-L5, which is longer than mean length Y-L4. Each of yoke laminations 707-1, 707-2, 707-3, 707-4, and 707-5 has a same transverse width W4, which may be the same as transverse width W1, W2, and/or W3. A dimension of transverse width W4 may be determined, in part, by desired magnetic flux properties of the transformer core. Each of yoke laminations 707-1, 707-2, 707-3, 707-4, and 707-5 has a diagonal cut at each of their longitudinal ends that complements the diagonal cut at a longitudinal end of leg laminations 403 and 605. The diagonal cuts may be at angle A1, which may be about 45 degrees. Other suitable angles are possible for the diagonal cuts, provided they complement the diagonal cuts at a longitudinal end of leg laminations 403 and 605 in order to form a transformer core corner. Each of yoke laminations 707-1, 707-2, 707-3, 707-4, and 707-5 also may have a centered V-shaped notch of different size (only V-shaped notch 716-1 is labeled in FIG. 7 to maintain clarity), or each of yoke laminations 707-1, 707-2, 707-3, 707-4, and 707-5 may have an offset V-shaped notch of the same size staggered horizontally (not shown). The V-shaped notch is cut into an inside (i.e., the shorter) longitudinal edge 718, as shown. Each V-shaped notch is dimensioned to complement a respective V-shaped longitudinal end of leg laminations 504 or 504A in order to form a step-lap joint thereat. Upper yoke laminations 707 may be used to construct, e.g., lower yoke 106 or upper yoke 107 of transformer core 102 (of FIG. 1), as described in more detail below.

Figure 8:
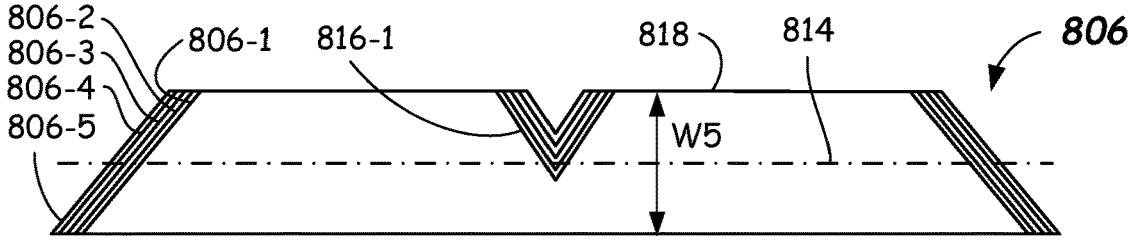

FIG. 8 illustrates lower yoke laminations 806, which may be identical to upper yoke laminations 707 (which may be flipped along a horizontal axis). Lower yoke laminations 806 may include a first yoke lamination 806-1 having a first mean length (all mean lengths measured along a center longitudinal axis 814) that may be equal to mean length Y-L1; a second yoke lamination 806-2 having a second mean length that may be equal to mean length Y-L2, which is longer than the first mean length; a third yoke lamination 806-3 having a third mean length that may be equal to mean length Y-L3, which is longer than the second mean length; a fourth yoke lamination 806-4 having a fourth mean length that may be equal to mean length Y-L4, which is longer than the third mean length; and a fifth yoke lamination 806-5 having a fifth mean length that may be equal to mean length Y-L5, which is longer than the fourth mean length. Each of yoke laminations 806-1, 806-2, 806-3, 806-4, and 806-5 has a same transverse width W5, which may be the same as transverse width W1, W2, W3, and/or W4. A dimension of transverse width W5 may be determined, in part, by desired magnetic flux properties of the transformer core. Each of yoke laminations 806-1, 806-2, 806-3, 806-4, and 806-5 has a diagonal cut at each of their longitudinal ends that complements the diagonal cut at a longitudinal end of leg laminations 403 and 605. The diagonal cuts may be about 45 degrees with respect to longitudinal axis 814 (i.e., same as angle A1). Other suitable angles are possible for the diagonal cuts, provided they complement the diagonal cuts at a longitudinal end of leg laminations 403 and 605 in order to form a transformer core corner. Each of yoke laminations 806-1, 806-2, 806-3, 806-4, and 806-5 also may have a centered V-shaped notch of different size (only V-shaped notch 816-1 is labeled in FIG. 8 to maintain clarity), or each of yoke laminations 806-1, 806-2, 806-3, 806-4, and 806-5 may have an offset V-shaped notch of the same size staggered horizontally (not shown). The V-shaped notch is cut into an inside (i.e., the shorter) longitudinal edge 818, as shown. Each V-shaped notch is dimensioned to complement a respective V-shaped longitudinal end of leg laminations 504 or 504A in order to form a step-lap joint thereat. Lower yoke laminations 806 may be used to construct, e.g., lower yoke 106 or upper yoke 107 of transformer core 102 (of FIG. 1), as described in more detail below.

Figure 9:
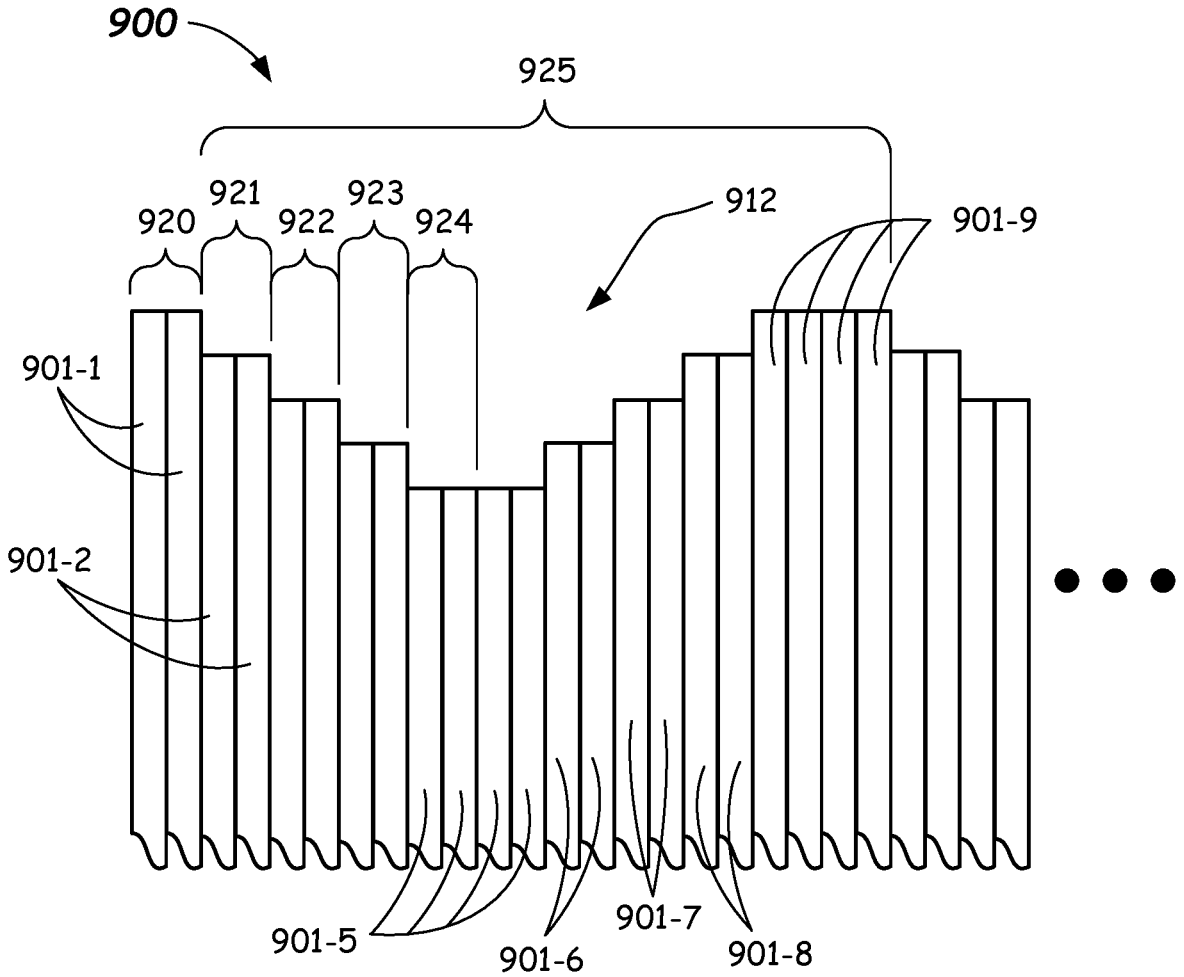
FIG. 9 illustrates a step-lap profile and a partial side view of transformer core leg laminations according to embodiments.

FIG. 9 illustrates a step-lap profile 900, which may also illustrate a partial side view of a stacked laminated construction of legs 103-105 of FIG. 1 and/or leg laminations 403, 504, and/or 605 of FIGS. 4-6, respectively, in accordance with one or more embodiments. Step-lap profile 900 may be used to form step-lap joints with leg laminations 403, 504, 504A, and 605 and upper yoke laminations 707 and lower yoke laminations 806 in the assembly of transformer core 102.

Step-lap profile 900 may have five groups 920, 921, 922, 923, and 924 of laminations, wherein each group has at least two identical longitudinally and transversely aligned laminations stacked directly to each other. Each group may also have a mean length different than an adjacent group to form four steps. For example, group 920 may have two identical laminations 901-1 each having a same mean length different than adjacent group 921, which has two identical laminations 901-2 each having a same mean length different than the mean length of laminations 901-1. In some embodiments, the size of each step may range from 3 mm to 7 mm. In other words, the mean length difference from one group to an adjacent group may range from 3 mm to 7 mm. Thus, the mean length difference between group 920 (having the longest mean length) and group 924 (having the shortest mean length) may range from 12 mm to 28 mm (i.e., separated by four steps). Note that the distances between the tips of the offset V-shaped longitudinal ends of leg laminations 504A may follow the same step dimensions. That is, e.g., the distance between the tip of the first offset V-shape of leg lamination 504A-1 and the tip of the second offset V-shape of leg lamination 504A-2 may be 3 mm to 7 mm, and so on. Other embodiments may have other suitable step dimensions.

The five groups 920, 921, 922, 923, and 924 of laminations are repeated, as shown, in a forward-backward pattern in accordance with one or more embodiments. This pattern results in a repeating step-lap sequence 925 that may begin after starter laminations 901-1. In some embodiments, step-lap sequence 925 may have at least 20 laminations that include at least four identical longitudinally and transversely aligned laminations 901-5 stacked directly to each other, each having the same shortest mean length of step-lap sequence 925. Step-lap sequence 925 may also include at least four other identical longitudinally and transversely aligned laminations 901-9 stacked directly to each other, each having the longest mean length of step-lap sequence 925. Stacked between laminations 901-5 and 901-9 may be three groups (forming respective steps) each having at least two identical longitudinally and transversely aligned laminations (e.g., laminations 901-6, 901-7, and 901-8) stacked directly to each other, each group having a mean length progressively different than an adjacent group to form a step there between. Step-lap sequence 925 may repeat to construct a transformer core leg or yoke of a desired thickness.

A benefit of step-lap profile 900 is the creation of an enlarged valley 912 (as compared to valleys created by known step-lap profiles, such as valley 312 of FIG. 3). Enlarged valley 912 advantageously allows an anti-corrosive paint, coating, and/or sealer to easily reach and fully (or at least adequately) cover and protect from harsh environments all areas in a transformer core corner formed using step-lap profile 900.

Figure 10:
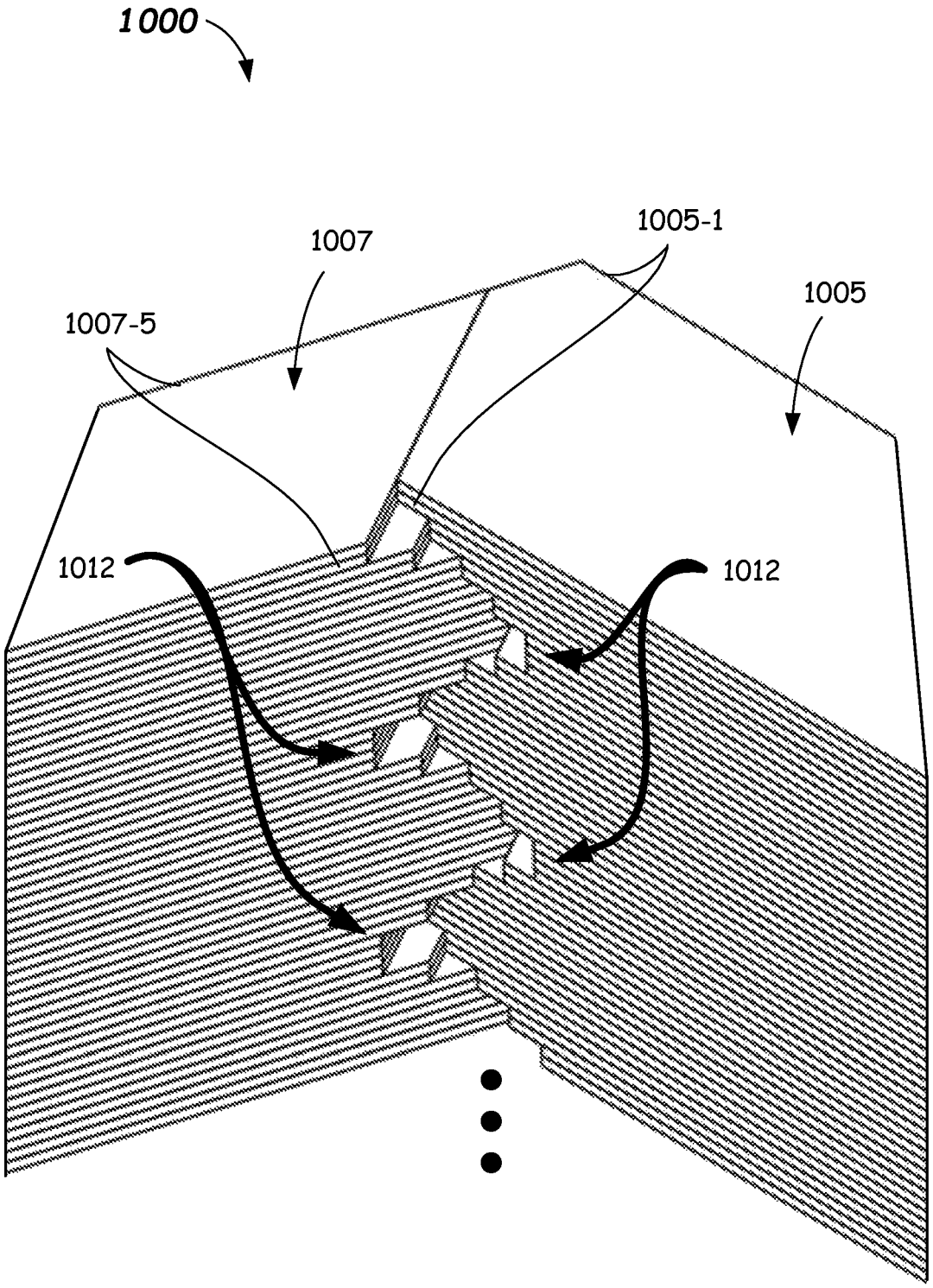
FIG. 10 illustrates a perspective view of a transformer core inside corner constructed according to embodiments.

FIG. 10 illustrates a transformer core corner 1000 constructed with a step-lap joint formed using step-lap profile 900 in accordance with one or more embodiments. Transformer core corner 1000 may be formed by abutting leg laminations 1005 with yoke laminations 1007. Leg laminations 1005 may be identical to leg laminations 403 and/or 605, and yoke laminations 1007 may be identical to upper yoke laminations 707 and/or lower yoke laminations 806. While leg laminations 1005 can be seen in FIG. 10 employing step-lap profile 900 as shown in FIG. 9 from two identical starter laminations 1005-1 (having the longest mean length) that correspond to starter laminations 901-1, yoke laminations 1007 employ step-lap profile 900 from a complimentary starting point. That is, yoke laminations 1007 may begin with two identical starter laminations 1007-5 (having the shortest mean length) that correspond to the two right-most laminations 901-5 of step-lap profile 900. Yoke laminations 1007 may then continue following step-lap profile 900 to the right of the two right-most laminations 901-5, as shown in FIG. 9.

As can be seen in FIG. 10, valleys 1012 created by the step-lap joints formed from step-lap profile 900 may be sufficiently large and wide to allow an anti-corrosive paint, coating, and/or sealer to be easily applied thereto to fully (or at least adequately) coat and protect those inside corner areas from harsh environments.

Each of diagonal joints 110A-110D and V-shaped joints 110E and 110F of transformer core 102 (FIG. 1) can be constructed with leg laminations 403 and/or 605, leg laminations 504, and upper yoke laminations 707 and/or lower yoke laminations 806 using step-lap profile 900 as illustrated by transformer core corner 1000. In an alternative embodiment, the starting laminations of the yokes and the legs may be reversed (i.e., the yokes may start with laminations having the longest mean length, while the legs may start with laminations having the shortest mean length). Also, in some embodiments, the starting laminations may have more than two laminations, such as, e.g., three, four, or more.

Figure 11:
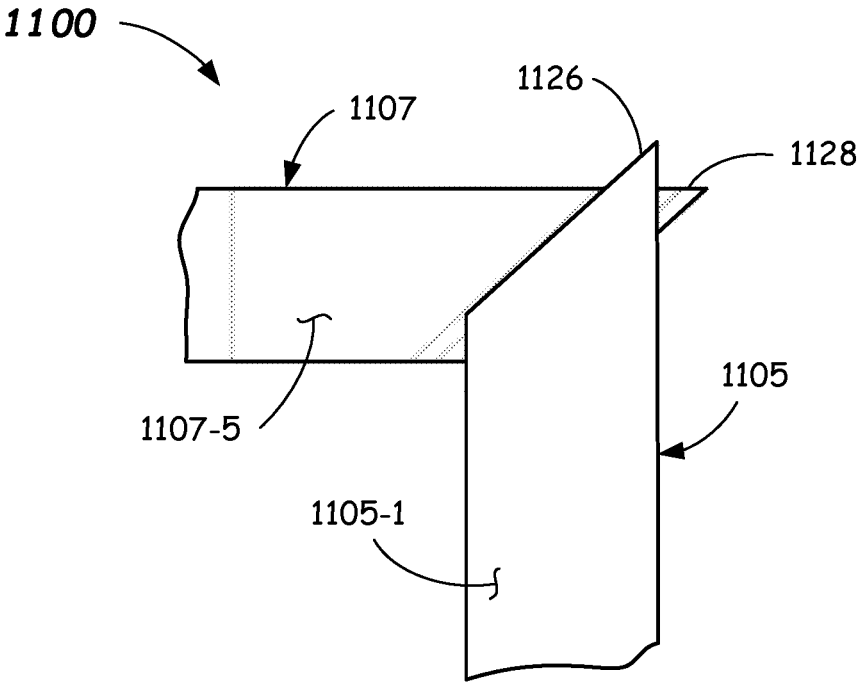
FIG. 11 illustrates a front view of a transformer core corner constructed without some laminations having corner tip cuts according to embodiments.

Prior to assembly of transformer core 102 using step-lap profile 900, some leg laminations and some yoke laminations may have a second cut at each of their longitudinal ends in addition to the diagonal cuts described above in accordance with one or more embodiments. The second cuts may be needed to maintain a uniform outer perimeter of transformer core 102 (in order to maintain magnetic flux performance) and/or to remove potentially dangerous sharp edges. For example, FIG. 11 illustrates a transformer core corner 1100 formed using step-lap profile 900 with leg laminations 1105 and yoke laminations 1107, each without having the second cut mentioned above. A leg lamination 1105-1, which may have the longest mean length of leg laminations 1105, may have a tip 1126 that extends beyond an outer perimeter of yoke laminations 1107 (which form an outer perimeter of an upper portion of the transformer core). Similarly, a yoke lamination 1107-5 (note that yoke laminations stacked above yoke lamination 1107-5 are not shown in FIG. 11 for clarity), which may have the longest mean length of yoke laminations 1107, may have a tip 1128 that extends beyond an outer perimeter of leg laminations 1105 (which form an outer perimeter of a side portion of the transformer core). Note that other laminations (such as, e.g., those having the second longest mean length), depending on the step dimensions and the number of steps in the step-lap profile used, may also have tips extending beyond an outer perimeter of the transformer core. In some embodiments, tips 1126 and 1128 (and other tips extending beyond an outer perimeter) may be cut prior to assembly of transformer core 102.

Figure 12:
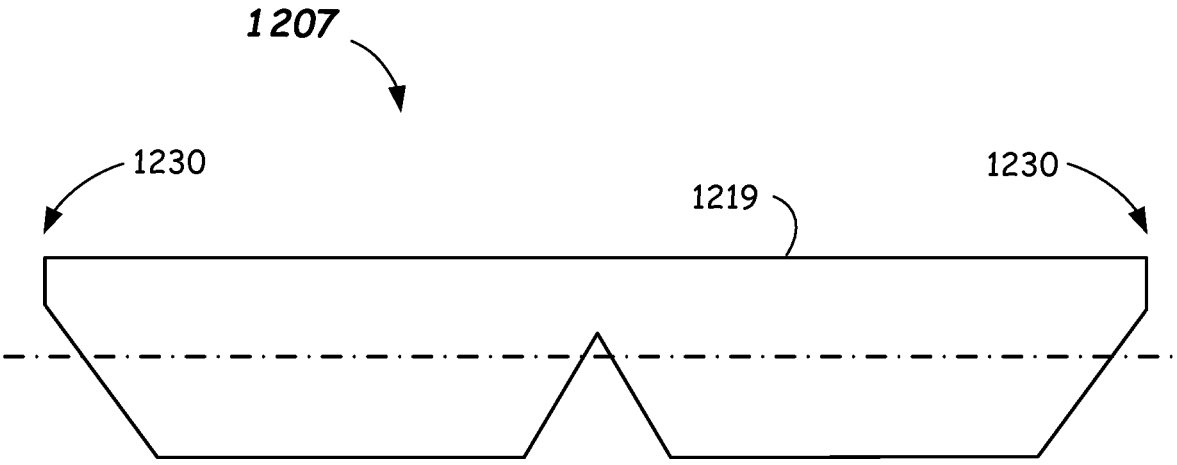
FIG. 12 illustrates a front view of a transformer core yoke lamination according to embodiments.

Accordingly, FIG. 12 illustrates an upper yoke lamination 1207, which may be the same as a longest or second longest one of upper yoke laminations 707, lower yoke laminations 806, and/or yoke laminations 1007 in accordance with one or more embodiments. Upper yoke lamination 1207 may have a second cut 1230 at each longitudinal end. A location of second cut 1230 may depend, at least, on the step dimension used. For example, referring to step-lap profile 900 having four steps and five lamination lengths, wherein each step may be, e.g., 3 mm to 7 mm, a second cut 1230 of a longest mean length lamination may be made about 6 mm to 14 mm from each longitudinal end measured from the longest longitudinal edge 1219. A second cut 1230 of a second longest mean length lamination may be made about 3 mm to 7 mm from each longitudinal end measured from the longest longitudinal edge 1219. Other suitable second cut dimensions are possible. Similar second cuts may also be made to longest and second longest leg laminations (and any other laminations as needed) of, e.g., leg laminations 403 and 605.

Figure 13A:
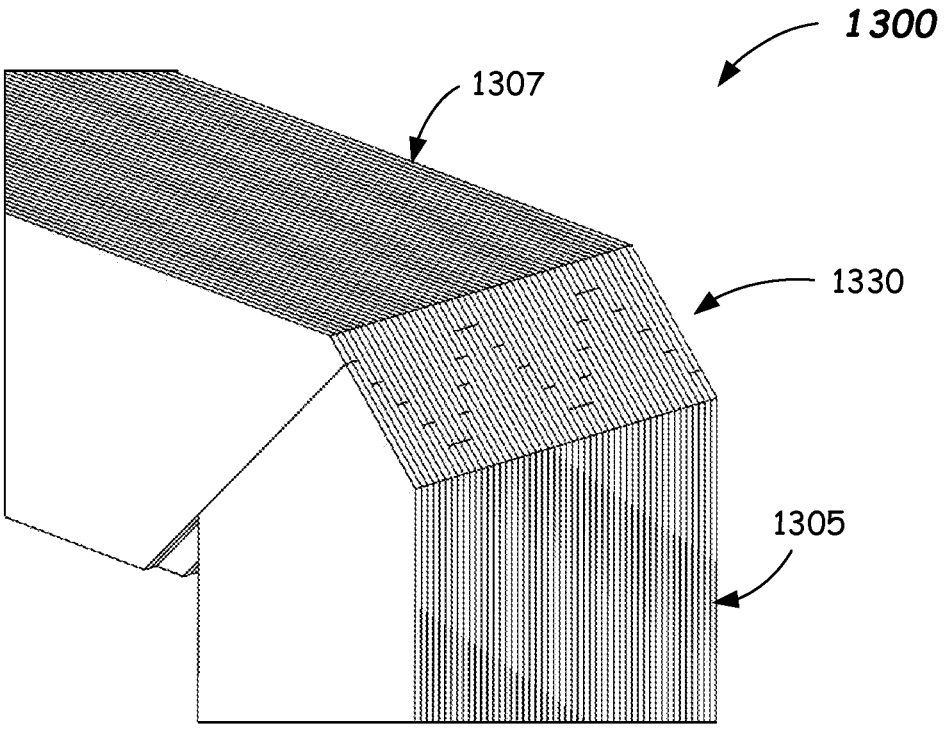
FIGS. 13A-13C illustrate a perspective and two front views, respectively, of a transformer core corner constructed with laminations having a second diagonal cut at each longitudinal end according to embodiments.
Figure 13B:
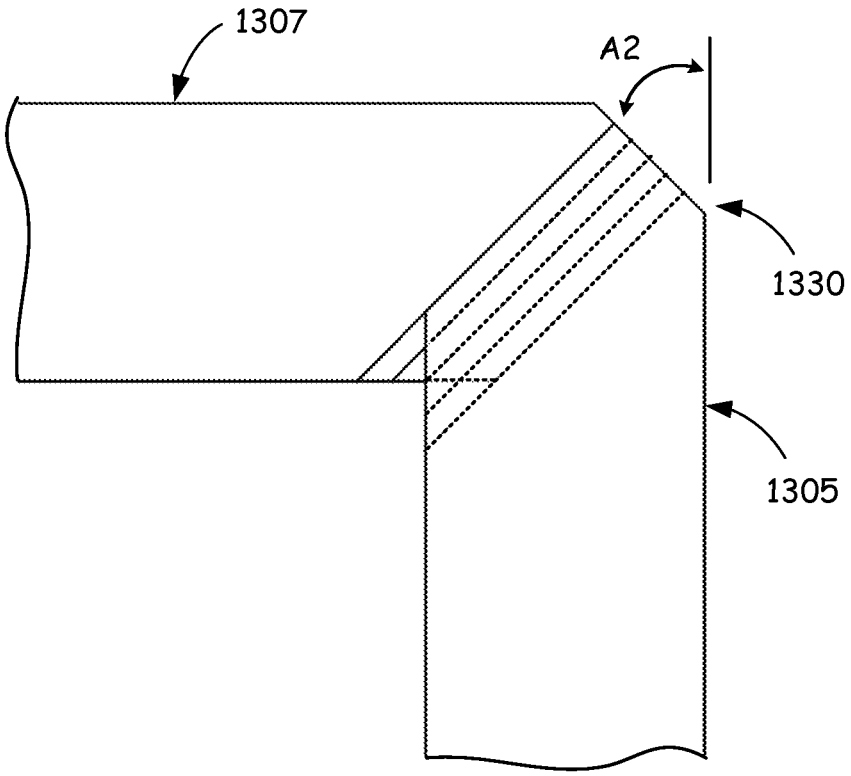
Figure 13C:
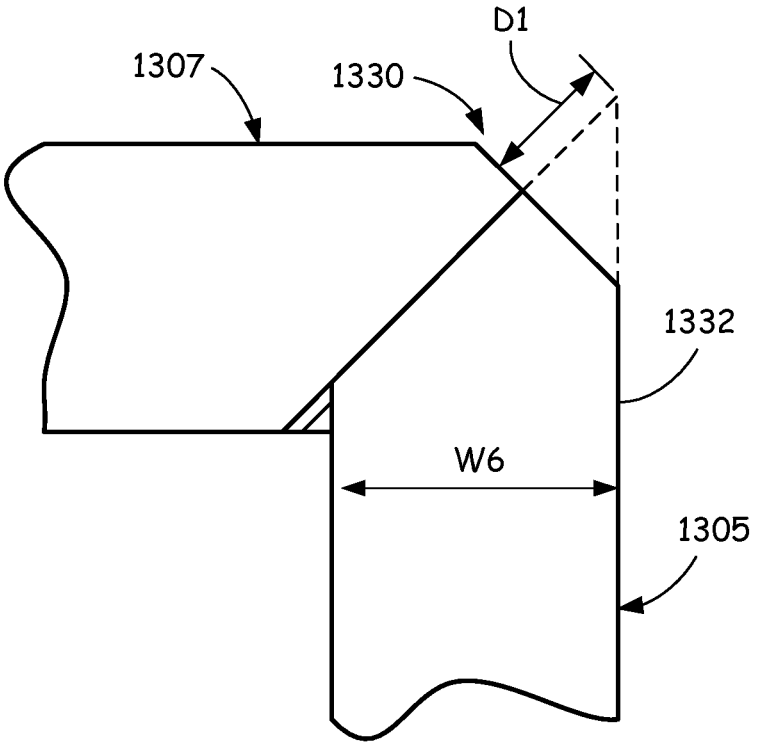

FIGS. 13A-13C illustrate another transformer core corner 1300 in accordance with one or more embodiments. Transformer core corner 1300 may be formed using step-lap profile 900 with leg laminations 1305 and yoke laminations 1307, which may be the same as leg laminations 403 and/or 605 and upper yoke laminations 707 and/or lower yoke laminations 806, respectively. Each leg lamination 1305 and yoke lamination 1307 may have a second diagonal cut 1330 made prior to transformer core assembly (which may render second cut 1230 unnecessary). Second diagonal cut 1330 is made opposite the first diagonal cut, creating an offset V-shape at each longitudinal end of each leg and yoke lamination. Second diagonal cut 1330 may be made at an angle A2 (see FIG. 13B) of about 45 degrees. Other suitable angles A2 are possible, provided that the cross-sectional area of the corner is substantially the same as the cross-sectional area of leg laminations 1305 and/or yoke laminations 1307. In some embodiments, second diagonal cut 1330 may be made starting at a distance D1 measured along the first diagonal cut from the tip of the longitudinal end of a longest lamination, as shown in FIG. 13C for a longest leg lamination 1305. Distance Dl may be about 0.4×width W6 or less (width W6 may be the same as any one of widths W1-W5). Second diagonal cut 1330 may then be made, in some embodiments, at a 45 degree angle with respect to a longitudinal edge 1332. Each successively shorter lamination may have second diagonal cut 1330 made at a distance D1 minus the appropriate multiple of the step dimension. Each of the four corners of transformer core 102 may be formed identically as transformer core corner 1300 with second diagonal cuts 1330. Transformer core corner 1300 advantageously eliminates the 90-degree corner that would otherwise be formed without second diagonal cut 1330, which may further improve magnetic flux performance by improving magnetic flux flow, reducing eddy currents, and/or reducing transformer noise.

Figure 14:
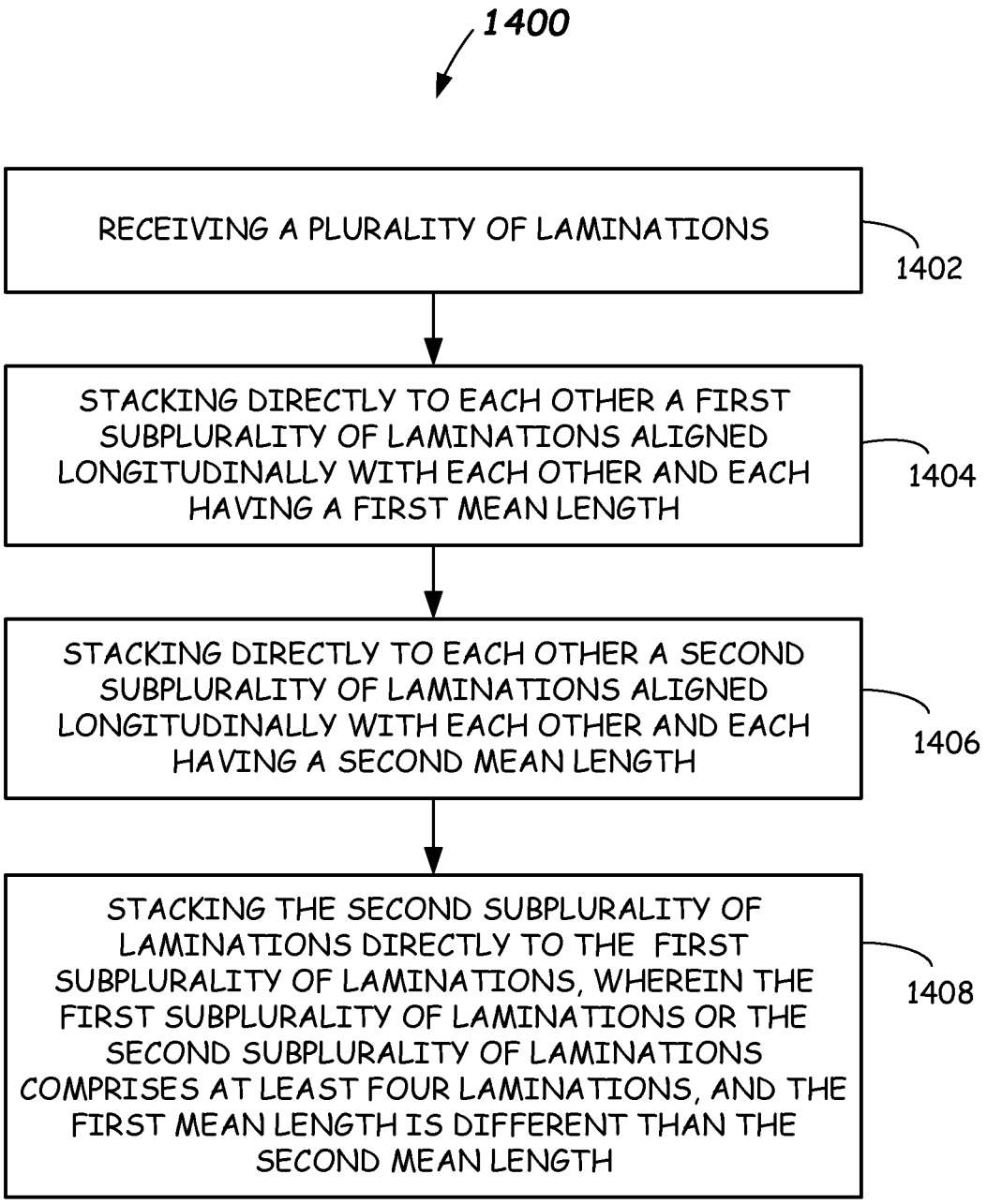
FIG. 14 illustrates a flowchart of a method of assembling a transformer core according to embodiments.

FIG. 14 illustrates a flowchart of a method 1400 of assembling a transformer core in accordance with one or more embodiments. Method 500 may include at process block 1402 receiving a plurality of laminations. For example, as shown in FIGS. 4-8, a plurality of laminations may be received that includes leg laminations 403 and/or 605, leg laminations 504, and upper yoke laminations 707 and/or lower yoke laminations 806 in sufficient quantity to construct a transformer core of desired size. The longitudinal lengths and transverse widths of each of the leg and yoke laminations may depend on the desired electrical and magnetic properties of the transformer core and the desired step dimensions of the step-lap profile used.

At process block 1404, method 1400 may include stacking directly to each other a first sub-plurality of laminations aligned longitudinally with each other and having a same first mean length.

At process block 1406, method 1400 may include stacking directly to each other a second sub-plurality of laminations aligned longitudinally with each other and having a same second mean length.

And at process block 1408, method 1400 may include stacking the second sub-plurality of the laminations directly to the first sub-plurality of the laminations, wherein the first sub-plurality of the laminations or the second sub-plurality of the laminations comprises at least four laminations and the first mean length is different than the second mean length.

Thus, e.g., as shown in FIG. 9, the first sub-plurality of laminations may be laminations 901-5 and the second sub-plurality of laminations may be laminations 901-6, or the first sub-plurality of laminations may be laminations 901-8 and the second sub-plurality of laminations may be laminations 901-9.

In some embodiments, method 1400 may additionally include: stacking directly to each other a third sub-plurality of the laminations aligned longitudinally with each other and each having a third mean length, stacking the third sub-plurality of the laminations directly to the second sub-plurality of the laminations; stacking directly to each other a fourth sub-plurality of the laminations aligned longitudinally with each other and each having a fourth mean length; stacking the fourth sub-plurality of the laminations directly to the third sub-plurality of the laminations; stacking directly to each other a fifth sub-plurality of the laminations aligned longitudinally with each other and each having a fifth mean length; and stacking the fifth sub-plurality of the laminations directly to the fourth sub-plurality of the laminations; wherein the first sub-plurality of the laminations comprises at least four laminations; and (1) the first mean length is longer than the second mean length, the second mean length is longer than the third mean length, the third mean length is longer than the fourth mean length, and the fourth mean length is longer than the fifth mean length; or (2) the first mean length is shorter than the second mean length, the second mean length is shorter than the third mean length, the third mean length is shorter than the fourth mean length, and the fourth mean length is shorter than the fifth mean length. In an example of (1) above, the first, second, third, fourth, and fifth sub-pluralities of laminations may be, respectively, laminations 901-9, 901-8, 901-7, 901-6, and 901-5 (see FIG. 9). In an example of (2) above, the first, second, third, fourth, and fifth sub-pluralities of laminations may be, respectively, laminations 901-5, 901-6, 901-7, 901-8, and 901-9.

While this disclosure is described primarily with regard to submersible dry-type transformers, it should be understood that the disclosed embodiments may also be applicable to other dry-type transformers, such as dry-type transformers that operate at high voltage (e.g., 110 kV), dry-type transformers for wind farms, or other dry-type transformers that may or may not be submersible.

The foregoing description discloses only example embodiments. Modifications of the above-disclosed apparatus, assemblies, and methods may fall within the scope of this disclosure. For example, although the examples discussed above are illustrated for power distribution systems, this disclosure may be applicable to other areas. Accordingly, it should be understood that the scope of the disclosure is limited only by the following claims.

What is claimed is:

1. A transformer core, comprising:

a first plurality of laminations stacked together having a first step-lap sequence of laminations including:

a first sub-plurality of the laminations each having a first mean length that extends along a longitudinal axis, which is transverse relative to a width of each of the first sub-plurality of laminations, the first sub-plurality of the laminations each aligned longitudinally with and stacked directly to each other; and a second sub-plurality of the laminations each having a second mean length that extends along the longitudinal axis, which is transverse relative to a width of the second sub-plurality of laminations, the second sub-plurality of the laminations each aligned longitudinally with and stacked directly to each other, the second sub-plurality of the laminations stacked directly to the first sub-plurality of the laminations;

wherein each respective one of the sub-plurality of the laminations of the first plurality of laminations is interconnected with a corresponding one of a sub-plurality of laminations of a second plurality of laminations having a second step-lap sequence of laminations to form a step-lap joint between the first plurality of laminations and the second plurality of laminations, wherein respective lengths of the second plurality of laminations extend transversely relative to the longitudinal axis, wherein the first step-lap sequence of laminations and the second step-lap sequence of laminations are complementary with one another;

a third sub-plurality of the laminations each having a third mean length that extends along the longitudinal axis, which is transverse relative to a width of each of the third sub-plurality of laminations, the third sub-plurality of the laminations each aligned longitudinally with and stacked directly to each other, the third sub-plurality of the laminations stacked directly to the second sub-plurality of the laminations;

a fourth sub-plurality of the laminations each having a fourth mean length that extends along the longitudinal axis, which is transverse relative to a width of each of the fourth sub-plurality of laminations, the fourth sub-plurality of the laminations each aligned longitudinally with and stacked directly to each other, the fourth sub-plurality of the laminations stacked directly to the third sub-plurality of the laminations; and a fifth sub-plurality of the laminations each having a fifth mean length that extends along the longitudinal axis, which is transverse relative to a width of each of the fifth sub-plurality of laminations, the fifth sub-plurality of the laminations each aligned longitudinally with and stacked directly to each other, the fifth sub-plurality of the laminations stacked directly to the fourth sub-plurality of the laminations;

wherein in a first sequential arrangement of a respective plurality of the first plurality of laminations and the second plurality of laminations, the first mean length is longer than the second mean length, the second mean length is longer than the third mean length, the third mean length is longer than the fourth mean length, and the fourth mean length is longer than the fifth mean length, wherein the first sequential arrangement defines a gradual transition from a respective peak to a respective valley of a plurality of successively alternating peak and valleys defined by plurality of laminations, wherein the respective peak is defined at least in part by the first sub-plurality of the laminations and the respective valley is defined at least in part by the fifth sub-plurality of the laminations, wherein in a second sequential arrangement of another respective plurality of the first plurality of laminations and the second plurality of laminations, the first mean length is shorter than the second mean length, the second mean length is shorter than the third mean length, the third mean length is shorter than the fourth mean length, and the fourth mean length is shorter than the fifth mean length, wherein the second sequential arrangement defines a gradual transition from the respective valley to a further peak of the plurality of successively alternating peak and valleys defined by the plurality of laminations.

2. The transformer core of claim 1 wherein the plurality of successively alternating peak and valleys each comprises at least four laminations.

3. The transformer core of claim 1 wherein each lamination of the plurality of laminations has a diagonally cut longitudinal end.

4. The transformer core of claim 1 wherein the first plurality of laminations comprises a vertical leg of the transformer core.

5. The transformer core of claim 4 wherein each lamination of the first plurality of laminations has a V-shaped longitudinal end.

6. The transformer core of claim 1 wherein the second plurality of laminations comprises a horizontal yoke of the transformer core.

7. The transformer core of claim 6 wherein each lamination of the second plurality of laminations comprises a V-shaped notch.

8. The transformer core of claim 1 wherein each lamination of the first plurality of laminations and each lamination of the second plurality of laminations comprises electrical steel.

9. The transformer core of claim 1 wherein the first mean length is 3 mm to 7 mm longer or shorter than the second mean length.

10. The transformer core of claim 1 wherein each lamination of the plurality of laminations has a same transverse width and the plurality of laminations are aligned transversely.

11. A transformer, comprising:

a transformer core comprising a plurality of legs, a lower yoke, and an upper yoke, each leg interconnected to the lower yoke and to the upper yoke via a step-lap joint; and a plurality of coils, each coil surrounding a respective leg; wherein:

each leg, the lower yoke, and the upper yoke comprises a respective plurality of laminations stacked together having a step-lap sequence of laminations including:

a first sub-plurality of the laminations each having a first mean length that extends along a longitudinal axis, which is transverse relative to a width of each of the first sub-plurality of laminations, the first sub-plurality of the laminations each aligned longitudinally with and stacked directly to each other; and a second sub-plurality of the laminations each having a second mean length that extends along the longitudinal axis, which is transverse relative to a width of each of the second sub-plurality of laminations, the second sub-plurality of the laminations each aligned longitudinally with and stacked directly to each other, the second sub-plurality of the laminations stacked directly to the first sub-plurality of the laminations;

a third sub-plurality of the laminations each having a third mean length that extends along the longitudinal axis, which is transverse relative to a width of each of the third sub-plurality of laminations, the third sub-plurality of the laminations each aligned longitudinally with and stacked directly to each other, the third sub-plurality of the laminations stacked directly to the second sub-plurality of the laminations;

a fourth sub-plurality of the laminations each having a fourth mean length that extends along the longitudinal axis, which is transverse relative to a width of each of the fourth sub-plurality of laminations, the fourth sub-plurality of the laminations each aligned longitudinally with and stacked directly to each other, the fourth sub-plurality of the laminations stacked directly to the third sub-plurality of the laminations; and a fifth sub-plurality of the laminations each having a fifth mean length that extends along the longitudinal axis, which is transverse relative to a width of each of the fifth sub-plurality of laminations, the fifth sub-plurality of the laminations each aligned longitudinally with and stacked directly to each other, the fifth sub-plurality of the laminations stacked directly to the fourth sub-plurality of the laminations; wherein:

wherein in a first sequential arrangement of a respective plurality of the first plurality of laminations and the second plurality of laminations, the first mean length is longer than the second mean length, the second mean length is longer than the third mean length, the third mean length is longer than the fourth mean length, and the fourth mean length is longer than the fifth mean length;

wherein the first sequential arrangement defines a gradual transition from a respective peak to a respective valley of a plurality of successively alternating peak and valleys defined by the plurality of laminations, wherein the respective peak is defined at least in part by the first sub-plurality of the laminations and the respective valley is defined at least in part by the fifth sub-plurality of the laminations, wherein in a second sequential arrangement of another respective plurality of the first plurality of laminations and the second plurality of laminations, the first mean length is shorter than the second mean length, the second mean length is shorter than the third mean length, the third mean length is shorter than the fourth mean length, and the fourth mean length is shorter than the fifth mean length, wherein the second sequential arrangement defines a gradual transition from the respective valley to a further peak of the plurality of successively alternating peak and valleys defined by the plurality of laminations.

12. The transformer of claim 11 wherein the plurality of legs comprises three legs and the plurality of coils comprises three coils.

13. The transformer of claim 11 wherein:

each lamination of the plurality of laminations of a first leg has a diagonally cut longitudinal end;

each lamination of the plurality of laminations of a second leg has a V-shaped longitudinal end; and each lamination of the plurality of laminations of the upper yoke comprises a V-shaped notch.

14. A method of assembling a transformer core, comprising:

receiving a first plurality of laminations having a first step-lap sequence of laminations;

stacking directly to each other a first sub-plurality of laminations aligned longitudinally with each other and each having a first mean length that extends along a longitudinal axis, which is transverse relative to a width of each of the first sub-plurality of laminations;

stacking directly to each other a second sub-plurality of laminations aligned longitudinally with each other and each having a second mean length that extends along a longitudinal axis, which is transverse relative to a width of each of the second sub-plurality of laminations; and stacking the second sub-plurality of the laminations directly to the first sub-plurality of the laminations;

interconnecting each respective one of the sub-plurality of the laminations of the first plurality of laminations with a corresponding one of a sub-plurality of laminations of a second plurality of laminations having a second step-lap sequence of laminations to form a step-lap joint between the first plurality of laminations and the second plurality of laminations, wherein respective lengths of the second plurality of laminations are disposed transverse relative to the longitudinal axis, wherein the first step-lap sequence of laminations and the second step-lap sequence of laminations are complementary with one another;

stacking directly to each other a third sub-plurality of the laminations aligned longitudinally with each other and each having a third mean length that extends along the longitudinal axis, which is transverse relative to a width of each of the third sub-plurality of laminations;

stacking the third sub-plurality of the laminations directly to the second sub-plurality of the laminations;

stacking directly to each other a fourth sub-plurality of the laminations aligned longitudinally with each other and each having a fourth mean length that extends along the longitudinal axis, which is transverse relative to a width of each of the fourth sub-plurality of laminations;

stacking the fourth sub-plurality of the laminations directly to the third sub-plurality of the laminations;

stacking directly to each other a fifth sub-plurality of the laminations aligned longitudinally with each other and each having a fifth mean length that extends along the longitudinal axis, which is transverse relative to a width of each of the fifth sub-plurality of laminations; and stacking the fifth sub-plurality of the laminations directly to the fourth sub-plurality of the laminations, wherein in a first sequential arrangement of a respective plurality of the first plurality of laminations and the second plurality of laminations, the first mean length is longer than the second mean length, the second mean length is longer than the third mean length, the third mean length is longer than the fourth mean length, and the fourth mean length is longer than the fifth mean length, wherein the first sequential arrangement defines a gradual transition from a respective peak to a respective valley of a plurality of successively alternating peak and valleys defined by the plurality of laminations, wherein the respective peak is defined at least in part by the first sub-plurality of the laminations and the respective valley is defined at least in part by the fifth sub-plurality of the laminations, wherein in a second sequential arrangement of another respective plurality of the first plurality of laminations and the second plurality of laminations, the first mean length is shorter than the second mean length, the second mean length is shorter than the third mean length, the third mean length is shorter than the fourth mean length, and the fourth mean length is shorter than the fifth mean length, wherein the second sequential arrangement defines a gradual transition from the respective valley to a further peak of the plurality of successively alternating peak and valleys defined by the plurality of laminations.

15. The method of claim 14 further comprising:

cutting diagonally a longitudinal end of each lamination of the first plurality of laminations prior to stacking; and forming a leg of the transformer core with stacked first and second sub-pluralities of laminations of the first plurality of laminations.

16. The method of claim 14 further comprising:

cutting a V-shape at a longitudinal end of each lamination of the first plurality of laminations prior to stacking; and forming a center leg of the transformer core with stacked first and second sub-pluralities of laminations of the first plurality of laminations.

17. The method of claim 14 further comprising:

cutting a V-shaped notch into each lamination of the second plurality of laminations prior to stacking; and forming a yoke of the transformer core with stacked first and second sub-pluralities of laminations of the second plurality of laminations.

* * * * *